US009061345B2

(12) United States Patent
Hamilton

(10) Patent No.: US 9,061,345 B2
(45) Date of Patent: Jun. 23, 2015

(54) SCREW CONVEYORS, AUGERS, AND FLIGHTING FOR USE THEREIN

(71) Applicant: Lenham Machinery Limited, Watford (GB)

(72) Inventor: Michael D. Hamilton, Northwood (GB)

(73) Assignee: LENHAM MACHINERY LTD, Watford (GB)

( * ) Notice: Subject to any disclaimer, the term of this patent is extended or adjusted under 35 U.S.C. 154(b) by 0 days.

(21) Appl. No.: 14/247,525

(22) Filed: Apr. 8, 2014

(65) Prior Publication Data

US 2014/0305262 A1 Oct. 16, 2014

Related U.S. Application Data

(60) Provisional application No. 61/810,651, filed on Apr. 10, 2013.

(51) Int. Cl.

| | |
|---|---|
| ***B21H 3/12*** | (2006.01) |
| ***B21B 13/00*** | (2006.01) |
| ***B21D 11/06*** | (2006.01) |

(52) U.S. Cl.

CPC ..... *B21H 3/12* (2013.01); *B21B 13/008* (2013.01); *B21D 11/06* (2013.01)

(58) Field of Classification Search

USPC ..... 72/67, 95, 99, 112, 136, 137, 167, 240, 72/252.5, 371

See application file for complete search history.

(56) References Cited

U.S. PATENT DOCUMENTS

| | | | | |
|---|---|---|---|---|
| 368,569 | A * | 8/1887 | Caldwell | 72/136 |
| 1,647,843 | A * | 11/1927 | Smith | 492/1 |
| 1,684,254 | A | 4/1928 | Bailey | |
| 1,775,888 | A * | 9/1930 | Christian | 198/666 |
| 2,262,227 | A | 11/1941 | Fulson | |
| 2,280,847 | A | 4/1942 | Pitcher | |
| 2,815,790 | A * | 12/1957 | Mayrath | 72/136 |
| 5,678,440 | A * | 10/1997 | Hamilton | 72/136 |
| 6,308,549 | B1 * | 10/2001 | Tokizawa et al. | 72/136 |
| 7,493,685 | B2 * | 2/2009 | Issagholian-Havai | 29/463 |
| 8,069,973 | B2 * | 12/2011 | Wynnobel et al. | 198/666 |

FOREIGN PATENT DOCUMENTS

DE 3111603 A1 * 10/1982 ..... B21B 1/08

* cited by examiner

*Primary Examiner* — Edward Tolan

(74) *Attorney, Agent, or Firm* — Merek, Blackmon & Voorhees, LLC

(57) ABSTRACT

In a continuous screw conveyor or auger, the rotatable screw member comprises a helical radial blade ("flighting") carried on a central driving shaft. The flighting is formed by providing a raw metal strip, generally of uniform thickness, performing optional compression and flaring of the metal strip, and rolling the metal strip between a pair of opposed, preferably offset, conical rolls. In contrast to prior art rolls, the present invention provides on at least one of those rolls a stepped conical rolling surface formed so as to exert a lesser and reducing rolling pressure on an outer portion of the helical blade being formed, thereby to produce a blade in which the outer portion tapers to a thickness which is preferably 125% of the thickness of the ingoing material to provide a greater wear resistant surface, a longer working life to the flighting and improved output performance.

25 Claims, 5 Drawing Sheets

SCREW CONVEYORS, AUGERS, AND FLIGHTING FOR USE THEREIN

CROSS REFERENCE TO RELATED APPLICIATIONS

This application claims the benefit of U.S. Provisional Application 61/810,651, filed Apr. 10, 2013, entitled Improved Screw Conveyors, Augers, and Flighting for Use Therein, which is incorporated herein by reference.

BACKGROUND OF THE INVENTION

1. Field of the Invention

This invention relates to methods and machines for producing continuous helical flighting for use in screw conveyors, augers and like material transporting, conveying or propelling means, and to machines incorporating such flighting.

Screw conveyors, augers and the like means incorporate or comprise a screw member for propelling particulate, granular or other free-flowing material (solid or liquid) along the length of the screw member in an axial direction as determined by the sense of rotation of the screw member. The propulsion of that material is achieved by the successive, often high speed turns of a continuous helical (spiral) blade (known in the art as flighting) which in most cases encircles, is secured on, and radiates from a central driving shaft which is arranged for rotation by an appropriate power source (manual or otherwise). However, some screw conveyors comprise solely such flighting, the flighting itself being driven by the power source, and the intrinsic strength of the flighting being sufficient to maintain the helical shape of the flighting whilst being driven.

In the case of a screw conveyor, the material being propelled by the successive turns of the blade is confined to the spaces between successive turns by a casing which encloses and cooperates with the outer periphery of the blade. In the case of hole-boring augers, however, the material being propelled by the successive turns of the blade is confined to the spaces between successive turns by the cylindrical wall of the hole being bored by the auger.

Though in some cases the screw member is of integral form, in most cases and for a variety of reasons, it is customary to form the helical blade separately, and independently of the driving shaft, first by rolling a metal strip between opposed mutually-inclined surfaces of a pair of rolls to form continuous rolled flighting, and then by securing it, for example by welding, on the driving shaft. The rolls may then be mounted in alignment with one another (i.e. with their respective rotational axes in a common plane), or in an offset manner (i.e. with their respective rotational axes in transversely spaced planes).

It is also customary (a) to use rolls of conical form, and (b) to form the helical blade from metal strip of rectangular cross section and uniform thickness (see, for example, patent specification U.S. Pat. No. 2,262,227 (FULSON)).

As a natural consequence of the rolling process to form a helical blade of which the length of an outer edge of the blade is substantially greater than that of an inner edge portion of the blade, the thickness of the blade at its outer edge, measured (for example) normal to the blade, is substantially less than that at said inner edge portion (see, for example, patent specification U.S. Pat. No. 2,262,227 (FULSON), FIGS. 12-16). In other words, in the rolling process, the uniform thickness, rectangular strip is converted Into a blade of which the thickness of the blade progressively reduces from said inner edge portion to the outer edge. That reduction in thickness typically amounts to 50% of the thickness of said inner edge portion of the blade. The thickness at said inner edge portion is normally substantially the same as (or even greater than) that of the metal strip from which the blade is rolled.

Patent specification U.S. Pat. No. 2,262,227 (FULSON) discloses one example of a process for rolling such a helical blade for use as flighting, using mutually-inclined conical rolls. Patent specification GB 736,838 (WURAG) discloses another process of rolling such an helical blade, using parallel conical rolls.

In some cases, the whole of the transverse width of the metal strip has been passed between such rolls (as in the above-mentioned prior patent specifications), so as to produce a helical blade in which the blade thickness varied across the whole of the radial extent of the blade, that is, from the inner edge of the blade to the outer edge thereof. In such cases, said inner edge portion has been constituted merely by that inner edge of the blade.

In other cases, only part of the transverse width of the metal strip has been passed between the rolls, so as to produce a helical blade in which the blade thickness varied in only that part of the metal strip that had passed between the rolls. In those cases, said inner edge portion has extended a substantial radial distance from said inner edge towards the outer edge of the blade.

Furthermore, it is found in practice that the wear of the blade due to the friction of the material being axially propelled by the blade is greatest at the outer periphery of the blade (i.e. at the fastest moving part of the blade), so that the part of the blade that is initially the thinnest is subjected to the greatest rate of wear (see, for example, patent specification U.S. Pat. No. 1,684,254 (BAILEY)). This causes the blade to be discarded or refurbished prematurely, at a time when the inner parts of the blade still have substantial thickness and life.

To overcome that disadvantage, patent specification U.S. Pat. No. 1,684,254 (BAILEY) provided at the outer edge of a cold rolled helical blade a "thickened reinforcement or bead". Patent specification SU 772,664 (SAFRONOV) also provided a thickened outer edge portion on a rolled helical blade. Patent specification GB 472,254 (BARKER) disclosed the use of a thickened outer edge portion on a cast form of Archimedean screw, to overcome the greater wear that occurs at that portion of the screw.

Patent specification SU 772,664 (SAFRONOV) also discloses a rolling process in which (a) the main rolls 1,2 for producing the helical blade from a strip of rectangular transverse cross section have stepped rolling surfaces, (b) the cone angles of the main rolls 1,2 is relatively small, (c) the angle of inclination of their rotational axes is likewise relatively small, (d) an auxiliary pair of edge-forming rolls 6,7 is used to simultaneously thicken up the outer edge portion of the helical blade, and (e) the use of an edge-forming rolling pressure directed transversely to the main helix-forming rolling pressure is essential to the process described. In addition, the main rolls 1,2 and the auxiliary rolls 6,7 are capable of rolling only one size of strip material 8 and of producing only one size of helical blade 9.

In U.S. Pat. No. 5,678,440 issued Oct. 21, 1997 to Hamilton, which is incorporated herein by reference, shows a continuous screw conveyor or auger, the rotatable screw member (12) comprises a helical radial blade (28) (known as "flighting") which is preferably carried on a central driving shaft (26). The flighting (28) was formed by rolling a rectangular metal strip of uniform thickness between a pair of opposed, preferably offset, conical rolls (56, 58) in contrast to prior art rolls which had similar unstepped conical rolling surfaces, and produced a helical blade of which the radial thickness reduce progressively from the inner helical edge (30) of the blade to the outer helical edge (32). The Hamilton device provided on at least one of the rolls (58) a stepped conical rolling surface (94) formed so as to exert less rolling pressure on an outer portion of the helical blade (28) being formed, thereby to produce a blade in which the outer portion is of a thickness (preferably uniform) which was no less than and preferably greater than that of an inner part of the blade lying immediately radially inwards thereof.

U.S. Pat. No. 8,069,973 B2 issued 6 Dec. 2011 to Winnobel et. al., shows a method whereby a portion of the carrying surface of the helical blade between the inner and outer edges (See FIG. 11) is formed to produce a concave section 24. FIG. 7 shows a conical roll where the conical angle of the stepped portion 68 is the same as the overall conical angle of the roll and parallel with the conical angle of the base section 64. This prevents any progressive increase in thickness in the outer portion of the flighting 26. Further, any deflection of the rolls caused by introduction of the metal strip between them will reduce thickness in the outer portion 26 with negative impact upon the wear resistance of this portion of the flighting.

SUMMARY OF THE INVENTION

The present invention seeks to overcome the disadvantages of the prior art by providing flighting for a screw conveyor or the like that has a material thickness at the outer periphery of preferably 125% of the raw material thickness by controlling the amount of compression along a remote portion of the flighting during processing. One preferred method of achieving the thickness only along the outer edge is to process the metal strip prior to or simultaneous with feeding the metal strip into the rolling machine, for example by height-wise compression of the metal strip. Further, by radially increasing the thickness of outer portion of the helical blade to impel forward the material being conveyed.

For simplicity and convenience, in the description and the claims that follow hereafter, the helical blade may be referred to as "flighting" wherever convenient or appropriate, since this term is well known and understood in the art.

Flighting suitable for use in screw conveyors, augers and the like material transporting, conveying or propelling means may be formed by continuous cold rolling. Our preferred flighting comprises a continuous helical blade having radially spaced inner and outer helical edges, and which blade comprises Integrally (a) an inner helical portion which extends radially from the inner edge to a predetermined intermediate radius; (b) an intermediate helical portion which extends radially to the outer helical portion and the outer helical portion which extends radially to the outer edge, and in which blade the transverse thickness of the blade in the inner helical portion decreases gradually from a maximum value, to a minimum value at the intermediate radius, whereas the thickness of the blade in the outer helical portion is no less than said minimum value; and (c) expands from said minimum value to a greater value at the outer edge of the flighting.

One preferred method comprises:

A. providing a pair of opposed, mutually-inclined conical rolls of which at least one roll has a stepped conical rolling surface divided by graduated diameter-changing steps for providing a taper from the inner edge to a neck portion and an increasing thickness from the neck to an outer edge portion;

B. rotating those rolls in complementary directions;

C. providing a continuous metal strip of substantially rectangular cross section and substantially constant height; optionally pre-processing the metal strip, and introducing the metal strip to the rolling machine, between the rotating rolls;

D. causing the metal strip to be converted by the rolls into a helical blade constituting said continuous rolled flighting, in which blade the inner helical portion has been formed by the apex conical section of the stepped rolling surface, the intermediate helical portion (neck) has been formed by the intermediate conical section and the outer helical portion has been formed by the "base" conical section of the stepped rolling surface; and E. receiving and supporting said flighting on emerging from the rolls.

According to one aspect of the present invention, such a method is characterized in that conical rolls are arranged so that in the step (c) above the continuous metal strip is converted by the conical rolls alone into said continuous helical blade, without substantially reducing the height of the metal strip and without a simultaneous application to the metal strip of pressures directed transversely to the pressures exerted on the metal strip by the conical rolls.

According to a another aspect of the present invention, where pre-processing of the metal strip prior to or simultaneous with introduction of the metal strip to the rolling machine includes compressing the strip height-wise (i.e., perpendicular to the force applied by the conical rolls) to flare at least one edge of the metal strip to thicken the material prior to rolling the strip.

If desired, the second one of the conical rolls may likewise have a stepped rolling surface thereby to produce by said method flighting in which the helical blade has the outer helical portion projecting outwardly on both sides of the blade relative to the respective adjacent surfaces of the inner helical portion of the blade.

According to a second aspect of the present invention, within such a rolling machine, the conical rolls are arranged so that they alone form the helical blade, without substantially reducing the height of the metal strip during rolling and unaided by any means for simultaneously applying to the metal strip pressures directed transversely to the pressures exerted thereon by the conical rolls during rolling.

If desired, each of said conical rolls may have a stepped conical rolling surface divided by a diameter-reducing graduated steps progressing from an "apex" conical section of the rolling surface to an intermediate conical section to a "base" conical section of the rolling surface, thereby when operating on an ingoing metal strip of generally rectangular cross section and a generally constant height to produce pressure differentials in adjoining portions of the metal strip, and so produce continuous flighting in which the outer edge portion of the helical blade is reduced in thickness during the cold rolling to a thickness approximately 75%-100% of the thickness of the original raw metal strip. Compression of the outer portion can be controlled by adjustment of the conical angle of the "base" section of the profiled conical roll by comparison with the conical angle of the apex section.

Alternatively, pre-processing of the metal strip prior to or simultaneous with introduction of the metal strip to the rolling machine may include the additional step of compressing the metal strip height-wise to increase the thickness of a least one edge of the metal strip preferably 10-70% beyond its raw material thickness prior to introduction of the metal strip into the rolling machine conical rolls to provide a thicker edge on the flighting without having to use a thicker raw material metal strip.

In such an alternative rolling machine, the conical rolls are likewise arranged so that they alone form the helical blade, without substantially reducing the height of the metal strip entering the rolls and unaided by any means during rolling for simultaneously applying to the metal strip pressures directed transversely to the pressures exerted thereon by the conical rolls.

In either of the rolling machines just referred to above, the respective conical rolls may be positioned relative to one another so that their respective rotational axes lie offset from one another in spaced planes.

A rolling machine according to the present invention may include for the or each stepped conical roll, a roll housing, and a roll shaft rotatably mounted in the roll housing, the roll shaft having formed therein at one end a roll-receiving socket, and the roll being provided with attachment means for detachably securing the roll in the socket.

Each roll attachment means may comprise (a) a tapered stub shaft carried by the associated conical roll, which stub shaft is retained on the roll shaft, and (b) in the associated roll shaft a tapered socket for receiving the tapered stub shaft.

The present invention also extends to flighting as produced by a rolling method, or a rolling machine, according to the present invention. In such flighting, (a) the blade thickness may decrease gradually from the inner helical edge, or only from a predetermined radius disposed between the inner helical edge and the intermediate radius; and (b) the blade thickness may remain substantially constant with increase in radius towards the outer edge in an intermediate (neck) portion, and (c) the blade thickness in the outer helical portion may increase at a substantially constant rate with increase in radius towards the outer edge to a thickness approximately preferably 125% greater than the thickness of the ingoing raw metal strip.

Other features of the present invention will become apparent from a reading of the description that follows hereafter and of the claims appended at the end of that description.

One screw conveyor, continuous rolled flighting incorporated in that conveyor, a preferred method of making that continuous flighting, and an apparatus for carrying out that method of making continuous flighting, all according to the present invention, will now be described by way of preferred example, and with reference to the accompanying diagrammatic drawings.

DESCRIPTION OF THE PREFERRED EMBODIMENTS

Figure 1:
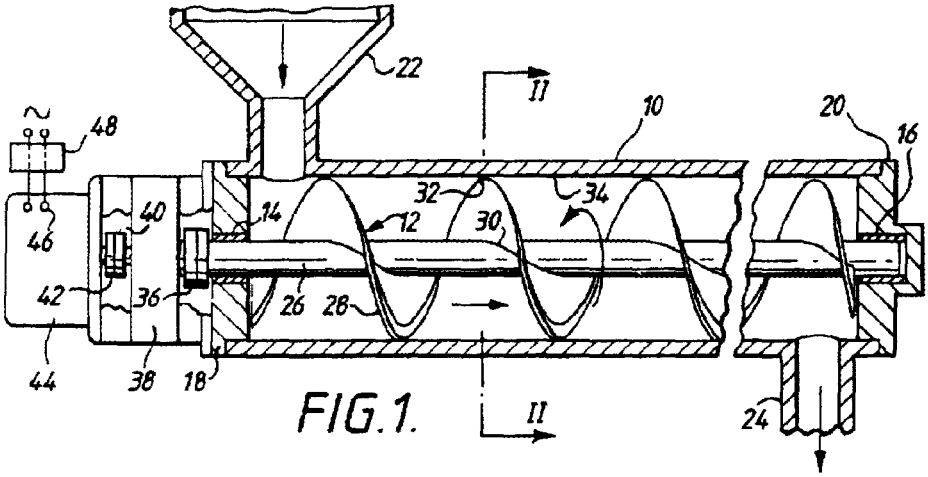
FIG. 1 shows a part sectional side elevation of the screw conveyor incorporating a screw member comprising continuous rolled flighting according to the present invention.
Figure 7:
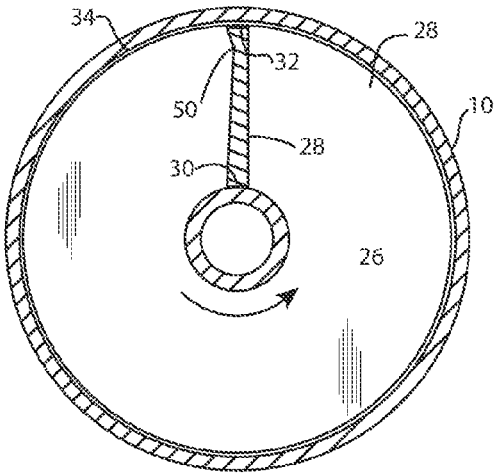
FIG. 7 shows a transverse section of a screw member incorporated in the screw conveyor of FIG. 1, as seen at the section II-II of FIG. 1.

Referring now to the drawings, the screw conveyor illustrated in the FIGS. 1 and 7 comprises a cylindrical casing 10 which encloses a rotatable steel screw 12. The screw is carried for rotation within the casing in bearings 14,16 mounted in end plates 18,20 which close the respective ends of the casing. An inlet funnel/hopper 22 opens into the upper portion of the casing 10 at its left hand end, whilst an outlet duct 24 opens from the casing at the lower portion of the right hand of the casing.

The screw 12 comprises a central, tubular driving shaft 26 on which is carried a continuous helical or spiral blade 28 (called in the art the flighting) of steel, which blade encircles and radiates from the driving shaft 26. The inner edge 30 of the flighting 28 engages with and is secured to the driving shaft 26, for example, by welding, whilst the outer edge 32 of the flighting cooperates relatively closely with the bore 34 of the casing.

The left hand end of the driving shaft extends through the bearing 14 carried in the end plate 18 and is connected to the output shaft 16 of a speed reducing gear unit 38, which unit is secured to the end of the casing 10. An input shaft 40 of the gear unit 18 is coupled to the output shaft 42 of an electric driving motor 44 which is coupled to the gear unit and is supplied through input terminals 46 as required by an electric control unit 48.

Energizing the driving motor 44 causes anti-clockwise rotation (as seen from the inlet end of the casing 10) of the driving shaft 26 and associated flighting 28, so that any free-flowing material supplied to the casing inlet end through the hopper 22 is engaged by the flighting and propelled from the inlet end to the outlet end of the casing, there to exit from the casing through the outlet duct 24.

Figure 8:
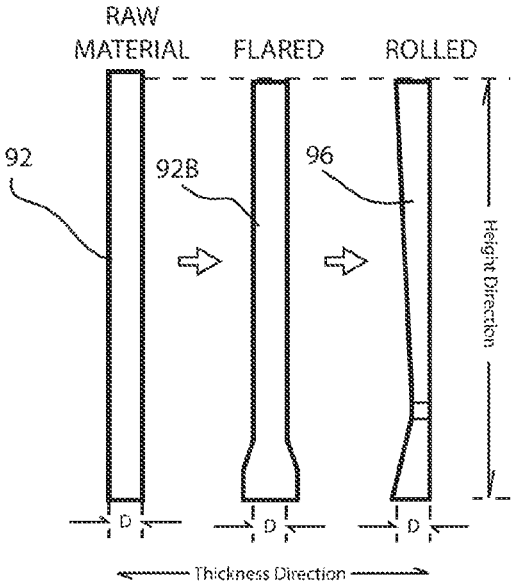
FIG. 8 shows a profile of a metal strip as a raw metal strip, after selective flaring of the metal strip, and after typical processing by a method according to one aspect of this invention.

The flighting 28 has a cross section transverse to the driving shaft which has the shape shown in the FIG. 7. FIG. 8 shows the "before" (LEFT), the "pre-processed" (CENTER) and the "after" of a metal strip processed by cold rolling (RIGHT). The original metal strip (92, FIG. 4) is reduced from the original raw material dimensions only in the portions intermediate the inner surface 30 and the outer surface 32. This leaves a portion 32 subject to wear that is substantially the same thickness D or thicker than the original strip 92 inputted to the rolling machine 49 or pre-compression unit 91. The flighting 28 outer section 32 rapidly tapers to neck 50, a preferably constant conical section that bridges between the outer portion 32 and the inner portion 30. The neck portion 50 optimizes thickness retention by spreading the compression load of the rolls ahead of the outer edge portion 32 also allows the work on the inner portion to not interfere with the outer portion by separating the two rolling processes from each other.

The thickness of the outer portion (as opposed to the inner portion) is key as this has been found to be the critical wear element in a screw conveyor that determines the life cycle of the device between repairs or between flighting replacement. Increasing the thickness of the outer edge without substantially increasing material or construction costs would be of great benefit to reducing the cost of operating the screw conveyor. The present invention provides a product and method of making the product that increases the outer thickness of the flighting from the current norm of around 50% of the raw material thickness to substantially 125% of the ingoing material thickness by altering the roller profile used in forming of the flighting and/or by pre-processing of the metal strip by, for example, compressing the strip in a height-wise direction to add thickness to at least the portion of the metal strip forming the outer portion 32. This provides substantially thicker wear surfaces than was available by any prior art system prior to this invention without requiring a thicker starting raw metal strip or thicker overall flighting. A thicker raw metal strip is less preferred, among other reasons, because of the increased cost and weight. It is desirable to have a thick outer edge portion 32 to allow for increase wear, while a thicker inner portion is less desirable because it may not add significantly to the wear life of the flighting yet may add substantially to weight and/or material or construction costs.

From FIGS. 7 & 8, it will be observed that in a preferred embodiment of the invention:

A. the flighting has its raw material thickness adjacent to its inner edge 30 where it abuts the cylindrical surface of the driving shaft 26 and is substantially thicker at the remote end 32;

B. the thickness of the flighting progressively reduces in a linear manner for the greater part of its radial extent, that is until the intermediate diameter 50 neck portion is reached, from which portion the thickness increases again to the remote end 32;

C. at that intermediate diameter a substantially uniform section 50 is provided as a neck for the flight; and D. that the change in thickness of the cross section of the flighting changes more rapidly towards the remote end 32 than it does from the neck portion towards the inner end 30.

Figure 2:
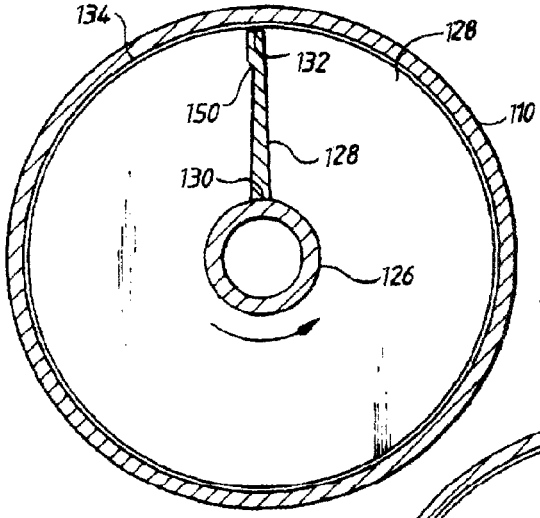
FIG.2. (PRIOR ART)
FIG. 2 shows a transverse section of a screw member incorporated in the screw conveyor of a prior art device, as seen at the section II-II of FIG. 1.
Figure 3:
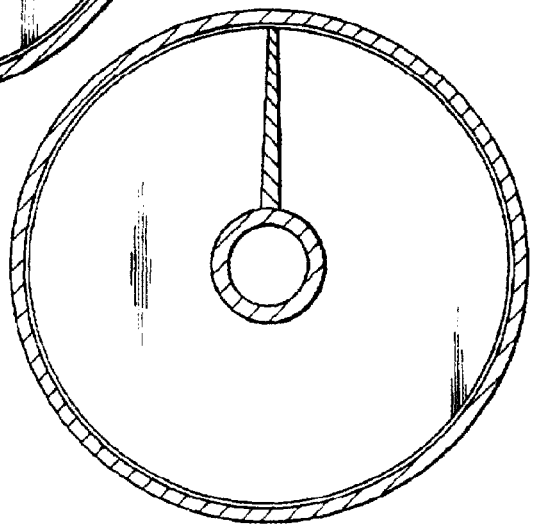
FIG.3. (PRIOR ART)
FIG. 3 shows a transverse section, similar to that of FIG. 2, of another prior art screw member over which the screw member of FIGS. 1 and 7 offers a substantial advantage.
Figure 4:
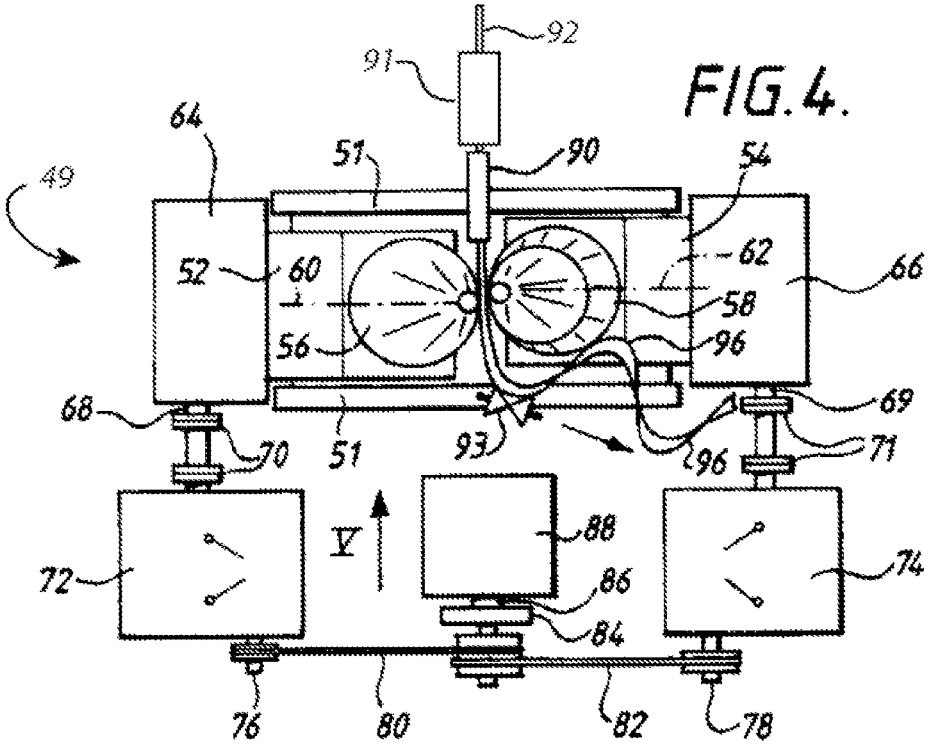
FIG. 4 shows a diagrammatic plan view of the principal components of a flighting rolling machine arranged for producing the continuous rolled flighting of the screw member shown in the FIGS. 1 and 7.
Figure 11:
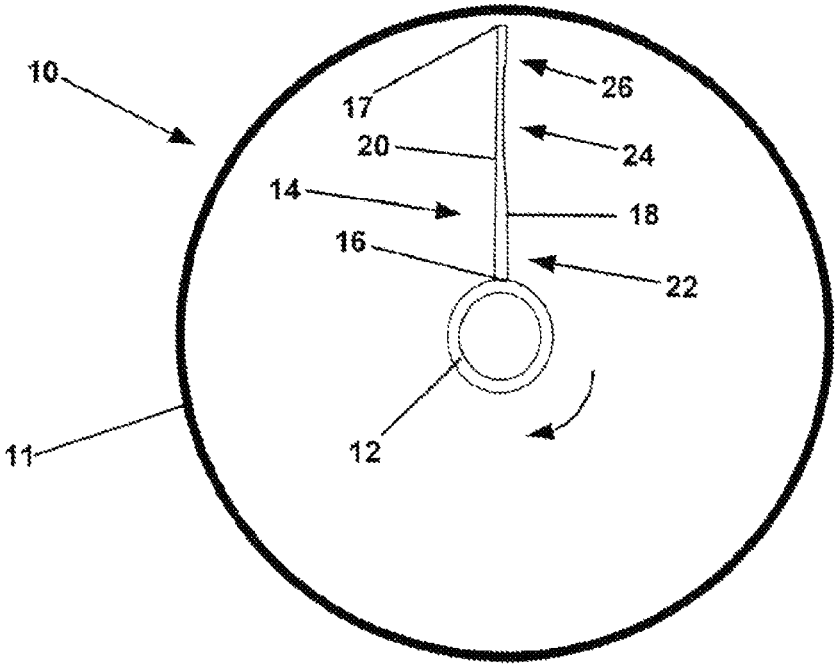
Fig. 11 (PRIOR ART)
FIG. 11 shows a transverse section of another prior art screw member over which the screw member of FIGS. 1 and 7 offers a substantial advantage

This transverse profile of the flighting should be compared with the corresponding transverse profile of the conventional (prior art) continuous rolled flighting, which is illustrated in the FIG. 3. It will be observed that there the thickness of the prior art flighting decreases progressively from its maximum value at its inner edge to its minimum value at its outer edge. Even in the profile of the blade according to U.S. Pat. No. 5,678,440 to Hamilton, the end of the blade 132, though thicker than the neck portion 150 (FIG. 2, PRIOR ART) has been reduced substantially from the original metal strip 92 (FIG. 4). The profile of the blade in U.S. Pat. No. 8,069,973 B2 to Winnobel shows at 17 (FIG. 11) a thickness substantially less than the raw material thickness 22. Before the current invention, no method of flighting manufacture by cold rolling of strip steel has achieved an outer edge thickness on the finished flighting greater than approximately 65% of the raw material's starting thickness. The current invention method represents a major edge thickness gain over all existing production methods using profiled conical forming rolls and an edge thickness gain in excess of 200% or even 250% over non-profiled conical roll-forming. In a less preferred embodiment, greater compression of the outer edge could be performed by altering the profile of the conical roller 58, but even compression to 95, 90 or 85% of the original thickness would be a marked improvement over the prior art flighting.

It should also be noted that in operation, the rate of surface wear of the flighting due to its frictional contact with the material being propelled by the flighting increases with an increase in the circumferential speed of the flighting surface relative to the material being propelled; and that the rate of frictional wear thus increases with the diameter at which the propelled material contacts the flighting. The increased edge thickness is thus a critical enhancement to durability and delivering a longer working life and a reduction in auger repairs and maintenance.

The rate of surface wear is minimal at the inner edge of the flighting, and maximal at the outer edge. Hence, the outer edge part of the flighting suffers the greatest rate of wear, and has the least life expectancy. This gives rise to a need for early replacement of the flighting; or otherwise a need for early refurbishment to add a replacement outer portion of the flighting, or alternatively to build up the thickness of the worn outer portion of the flighting, for example by welding.

The invention provides a means of enhancing the life expectancy of the flighting by providing a thickened outer portion on the flighting resulting from optionally thickening the metal strip by compression and then limiting rolling of the outer portion of the flighting 32. The radial extent of that thickened outer portion, and the increase in thickness in that portion can be adjusted so as to suit the particular requirements of the field of application of a particular screw conveyor and the material of the flighting. This is achieved by adjustment of the strip guide 90 to control height-wise location of the metal strip between the rolls.

Whereas in the embodiment described above with reference to the FIGS. 1 and 7, the thick portion of the flighting outer edge portion is shown protruding on the left hand side only (i.e. the material propelling side) of the profile (as seen in FIG. 7), the desired thickening could alternatively be produced on the other side of the profile (See FIG. 8), or partly on both sides of the profile ("symmetrically") (not shown).

Continuous flighting according to the present invention may be rolled in outside diameters ranging from approximately 40 mm to approximately 800 mm, with outer edge thickening designed and suited by experiment to the type of application for which the flighting is intended.

Continuous flighting according to the present invention as described above with reference to the FIGS. 1 and 7 may be produced on a conventional continuous flighting-rolling machine in which there has been substituted in place of its existing conventional prior art rolls, a pair of flighting-forming rolls in which at least one of the rolls has a modified rolling surface designed to produce the flighting profile illustrated in FIG. 7, or one of the modified forms thereof mentioned above.

In the rolling machine 49 shown in plan view in FIG. 4, a base structure 51 supports two roll housings 52,54 in which two conical flight-forming rolls 56,58 are mounted for rotation about transversely off-set axes 60,62 and at a mutual inclination such that the conical rolling surfaces of the cones may contact one another along respective radial lines.

Coupled to the respective roll housings 52,54 are speed reduction gear boxes 64,66 having input drive shafts 68,69 coupled through respective pairs of universal couplings 70,71 to respective speed-change selector boxes 72,74. Input shafts 76,78 of those selector boxes are coupled through timing belt transmissions 80,82 and a clutch 84 to an output shaft 86 of an electric driving motor 88.

A strip guide 90 positions and guides the raw metal strip material 92 transversely into the nip of the rotating rolls 56,58. The rolled strip emerges therefrom moving to the right as seen in FIG. 4, and rising out of the plane of the paper carrying that Figure to form a helical or spiral blade constituting continuous flighting. The flighting moves into contact with a supporting roller 93 which is mounted on a compound table (not shown) for adjustment in 'x' and 'y' directions and which serves to support/control the flighting at its outer edge. That compound table is used in appropriate cases to control (a) the diameter of the outer edge of the flighting, and/or (b) the axial pitch of the successive turns of the flighting. One skilled in the art would appreciate that the rolled strip could also emerge from the rollers 56,58 and move to the left (as viewed from the position of FIG. 4) as required or needed.

Figure 5:
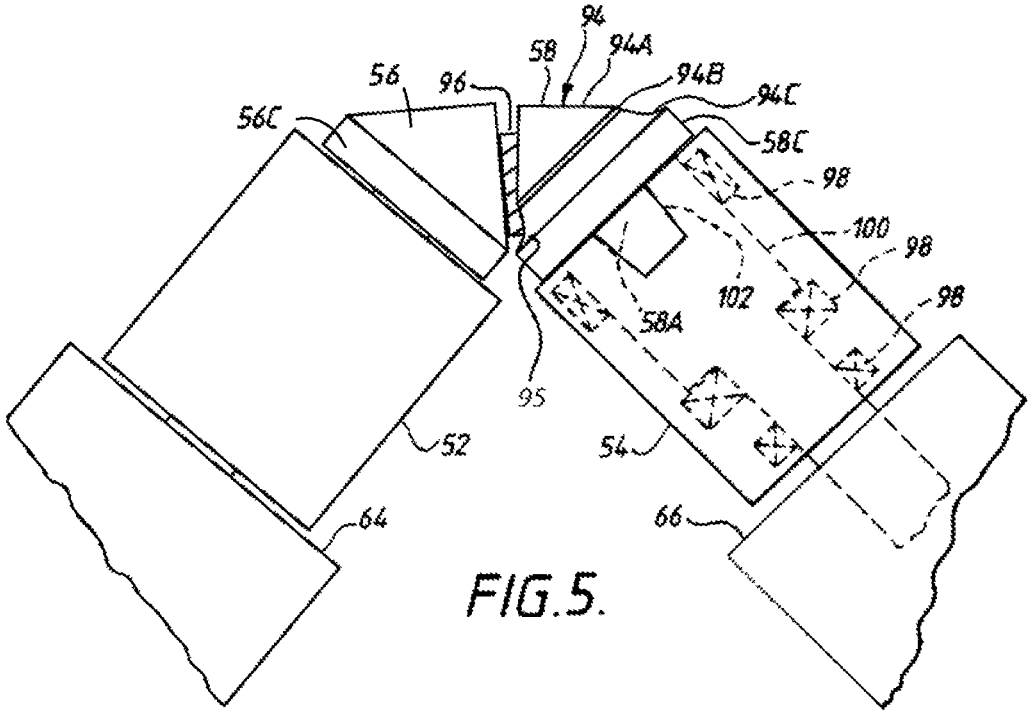
FIG. 5 shows a side elevation looking in the direction of the arrow 'V' shown in FIG. 4, and showing in particular the configuration and shape of the flighting-forming rolls incorporated in the apparatus of FIG. 4.

FIG. 5 shows in side elevation, as seen from the exit side of the rolls 56,58, the disposition and shape of those rolls 56,58, their associated roll housings 52,54 and parts of the associated speed reduction gear boxes 64,66.

It will be observed that the right hand roll 58 has a compound, generally-conical, stepped surface 94. The surface includes three successive sections 94A, 94B, 94C. The sections 94A and 94C are respectively an "apex" conical surface and a "base" conical surface which are spaced and connected smoothly by the generally conical intermediate "neck" surface 94B.

Figure 9:
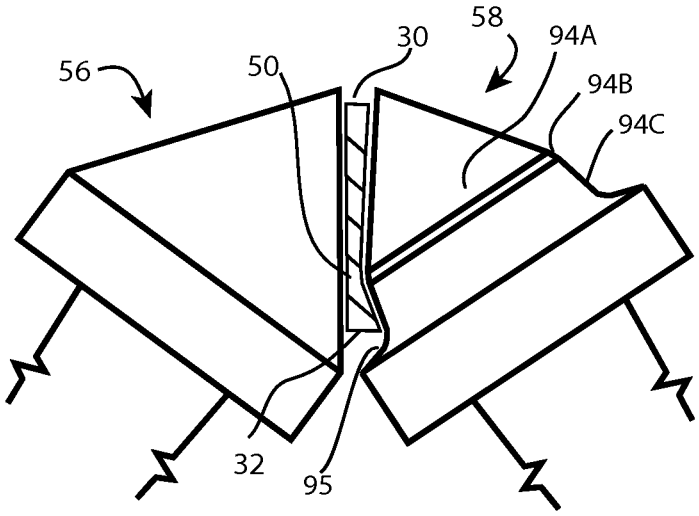
FIG. 9 shows a diagrammatic view of a metal strip being processed between two conical rolls.

In practice, the distance between the rollers 56,58 will determine the cross-sectional profile and the diameter of the finished flighting 28. As best shown diagrammatically in FIGS. 5 & 9, the distance between the upper section 94A and the roller 56 will form the first portion of the flighting between inner edge 30 and the neck portion 50. The shape of the rollers and the metal strip resulting from the cold rolling may be exaggerated in the drawings to show the impact the different profiles (94A-C) have on a metal strip. This first section 94A will form a gradual taper from the inner edge 30 to the neck portion as both conical rolls are subjected to deflection, according to the machine setting and the thickness of the raw material.

The step surface 94B is typically parallel when under load to the corresponding surface of the roller 56 and thus forms a generally constant thickness neck portion 50 on the flighting. This neck portion may typically cover 1-5% of the radial length of the flighting blade 28 and may optionally incorporate a radius.

The distance between the surface of the "base" conical portion 94C and the opposing roller 56 will form the section of the flighting between the neck portion 50 and the outer edge 32. Since the cone angle in the conical section 94C is less than the cone angle in section 94A there is a controlled reduction of compression of the metal strip in section 94C yielding a rapid increase in thickness tapering from the neck portion 50 to a maximum thickness at the outer edge of the flighting 32. Thickness at the outer edge is the primary determinant governing the wear resistance and working life of all flighting. The lower edge 95 of the roll section 94C may include a radius to relieve stress at the change of sections.

Figure 10:
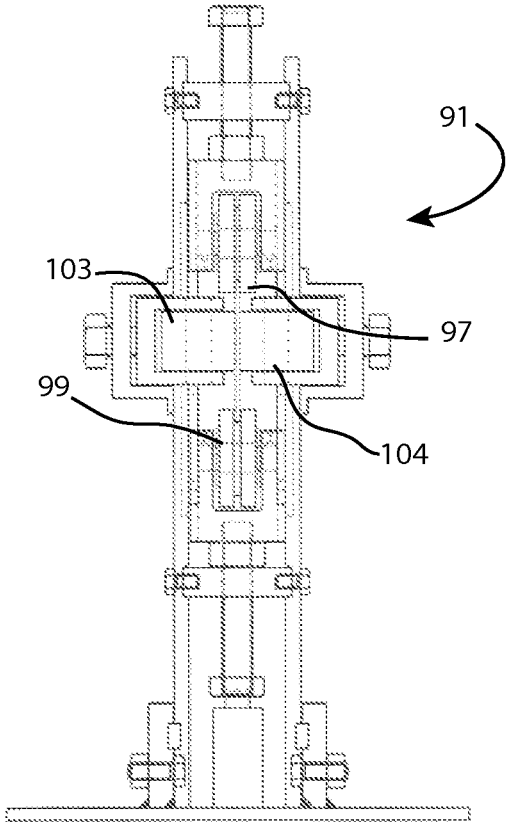
FIG. 10 shows an end view of a compressing machine for compressing the metal strip height-wise to flare at least one edge of the strip prior to rolling.

In a preferred but optional step, the metal strip may be pre-processed prior to or simultaneous with introduction into the rolling machine. As shown in FIGS. 4, 8 and 10, a raw metal strip 92 is provided to a rolling machine 49 for cold rolling. In order to maximize the thickness of the outer edge portion 32 of the flighting, the strip may undergo pre-processing. One such preferred pre-process utilizes a pre-compression machine 91. Two or more rollers 97,99 impart a height-wise compression force to the metal strip 92 (see FIG. 8) while two or more rollers 103,104 compress the metal strip width-wise. The compression causes a flaring of at least one end of the metal strip to form a flared metal strip 92B. By having one roller 97 sized to closely conform to the metal strip and the second roller 99 wider than the metal, the flaring of the metal strip will occur mostly in the area of the second roller. This area of the metal strip will later form the outer edge portion 32. While two pairs of rollers 97,99,103,104 are shown, more rollers or other sequential compression of the strip could be used. All rollers may optionally be driven to assist feeding of the metal strip into the machine 49. The central recess (groove) in the upper roller 97 and lower roller 99 are shown as rectangular but may optionally be tapered, incorporate concave or convex radius or be otherwise profiled to minimize height-wise reduction of the metal strip and maximize thickness along the lower edge of the metal strip.

Additionally, a taller metal strip may be used in this optional pre-processing so that after height-wise compression, the height of the strip matches the preferred height (i.e., is approximately the same height as the desired metal strip, when pre-processing is not utilized). The flaring can add 10-75% thickness or more to the metal strip in the portion that will become the outer edge portion 32 without adding thickness along the entire height of the metal strip. Preferably, height-wise compression on the strip adds 70% or more additional thickness to the lower edge portion FIG. 8 without substantially changing the thickness of the other portions of the metal strip. The flared metal strip 92B is then processed as described above through the rollers 56, 58 to produce flighting 96 having a profile as shown in FIG. 8. The rollers 56, 58 may thus compress the outer portion 32 of the flighting, but the final product will have a thickness tapering to an outer edge preferably 125% of the original raw material 92 thickness. The thickness at the outer edge will be much thicker than the neck portion, with at least a thickness of 125-150% of the minimum flighting thickness, but preferably 175, 200 or even 250% of the minimum thickness. This allows for selective thickening of the resultant flighting to enhance wear characteristics without requiring either the use of a thicker metal strip or by forming a flighting having additional, unnecessary thickness across the entire height of the strip (i.e., across the entire radius of the flighting).

If desired, additional compression of the strip between the rolls 56, 58 could occur beyond the original thickness of the raw metal strip. Because of the arrangement of the present invention and the roller profile(s), even a compression of 5, 10 or 25% of the thickness would still result in a flighting having an outer thickness substantially greater than the prior art flights manufactured by other methods.

Prior to the introduction of profiled conical forming rolls by Hamilton, all cold rolled spiral flighting produced from mild steel strip attained an outer edge thickness equal to approximately 50% of the thickness of the raw material before cold rolling. The logic of this is illustrated by calculating and comparing the length of the spiral at the outer periphery with the length of the spiral at the neutral axis for one pitch of flighting.

By contrast, this invention provides for the outer edge band of the flighting to taper radially outward from an inner intermediate section to the outer periphery at which point the flighting thickness is preferably 125% of the thickness of the raw material strip prior to cold rolling.

One skilled in the art would understand given the teachings of the present invention that the flighting could have any profile between the inner and outer edge and have an unreduced or increased outer edge thickness and still benefit from the teaching of the invention. Preferably, the neck occurs about one fifth or less of the distance from the outer edge to the inner, edge. However, one could design the profile of the conical rolls in many different configurations according to the design criteria for the flighting or based on the materials used, etc.

Preferably to increase the wear resistance of the flight, the steel strip is cold rolled height-wise (i.e., perpendicular to the force of the rollers 56, 58) prior to admittance to the rolling machine. The material is rolled perpendicularly to add edge thickness to the strip prior to exiting the strip guide 90. The metal strip then passes between the rollers 56, 58 where the flighting is formed. Since cold rolling adds surface hardness, the outer edge of the flighting receives a double benefit.

Additionally, the dimensions of the flighting may be adjusted according to the dimensions and/or characteristics of the flighting as desired:

A. The radial length and upper starting point of the Intermediate Section "neck" of the conical rolls may be adjusted according to the dimensions of the flighting to be rolled.

B. The difference in cone angle between the Apex Conical Section and the "Base" Conical Section of the conical roll/s may be varied according to the dimensions of the flighting to be rolled.

C. The radial length of the "Base" Conical Section of the conical forming roll/s may be varied according to the dimensions of the flighting to be rolled with appropriate adjustment to the Intermediate Conical Section "neck" immediately above the "Base" Conical Section.

The cross sectional shape of the strip emerging from between the rolls is indicated at 96 between the roll surfaces.

Figure 6:
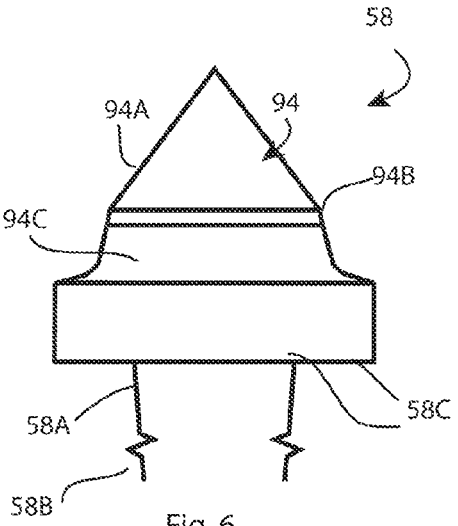
FIG. 6 shows an expanded side elevation a form of flighting-forming roll of the flighting-forming machine shown in FIG. 5.

If desired, the rolls 56,58 may have, in conventional manner, integral driving shafts which are rotatably mounted in bearings carried in the roll housings 52,54. That mode of construction renders the rolls not readily removable from their respective roll housings. However, since it is necessary to use In accordance with (a) the dimensions and nature of the strip material to be rolled and (b) the profile of the flighting to be produced, a stepped conical roll 58 specifically suited to production of the desired flighting, it is advantageous in accordance with a further feature of the present invention to make at least the stepped roll 58 in the manner of that shown in the FIG. 6, and to removably secure it in a socketed end of a driving shaft carried permanently in the roll housing 54. As shown in FIG. 6, the roll has a tapered stub-shaft 58A.

FIG. 5 shows the removable conical roll 58 carried in its roll housing 54. Bearings 98 secured in the roll housing 54 carry a rotatable, socketed driving shaft 100. That shaft has formed in its upper end a tapered socket 102 in which is selectively connected the tapered stub shaft 58A formed integrally with the conical roll 58. The conical roll 58 can thus be readily detached and removed from its driving shaft 100 whenever it is necessary to substitute in its place another conical roll of different configuration.

This mode of construction considerably reduces the machine down-time whilst changing from one flight-forming operation to a different one requiring a differently stepped conical roll 58.

If desired, the plain conical roll 56 can also be made in the same readily separable manner so as to render that roll readily removable without dissembling the associated roll housing, when it needs replacing or refurbishing.

Whereas in the FIG. 4, the flight-forming rolls 56,58 are shown with their rotational axes 60,62 disposed in spaced parallel planes (i.e. transversely off-set from one another), the machine may include means for adjusting the off-set of the rotational axes, so as to increase or decrease it and thereby influence the shape of the flighting emerging from the rolls. If desired, the off-set can be reduced to zero value, so that the rotational axes lie in a common plane.

It should be noted that:

A. the degree of off-set of those rotational axes and the pressure exerted on the strip material moving into the nip of the rolls are major factors in determining the dimensions of the flighting emerging from between the rolls;

B. by stepping one or both of the conical rolling surfaces of the rolls in the manner described above, the pressure exerted by the rolls on the outer edge portion of the flighting is diminished so that the thickened outer edge portion is produced; alternatively, the raw material may be pre-compressed to thicken at least an end portion such that rolling compresses the thickened portion back to preferably 125% of its original thickness;

C. the resultant thickness of the outer edge portion is best disposed on the side of the flighting that contacts the material being propelled, though it may be provided wholly on the other side of the flighting, or partly on both sides thereof;

D. though in the embodiments described above, the stepped roll 58 has but one smooth, graduated step 98B in its rolling surface, the bridge from the "apex" conical surface 94A to the "base" conical surface 94C may, if desired, be made in any other suitable manner, e.g. by a series of small smooth steps; and E. in the stepped roll 58, the cone angles of the respective "apex" and "base" conical surfaces 94A and 94C may be adjusted according to the nature of the transverse profile of the flighting to be rolled.

It will be appreciated that the method of making the flighting of the present invention comprises:

A. setting up in the manner described above with reference to the drawings, a pair of flighting-forming rolls at least one of which has a conical rolling surface which is stepped in a manner according to the present invention;

B. rotating the rolls in complementary directions;

C. guiding a metal strip of generally rectangular transverse cross section (or alternatively guiding a pre-processed, flared metal strip) into the nip of the rolls; and D. receiving the flighting emerging from between the rolls in a suitable supporting means.

In the embodiments described above, the flighting has been produced from a metal strip of substantially rectangular cross section by passing the whole of the transverse width of the strip between the rolls 56,58, as Indicated at 96 in FIG. 5. Another form of flighting may be produced by passing only a part of the transverse width of a metal strip between those rolls, to produce a flighting according to the present Invention in which there is an unrolled root portion of substantially constant thickness.

From the afore-going description, it will be appreciated that, as compared with the prior art methods of rolling continuous flighting from strip material, the rolling methods and machines according to the present invention provide in the rolled flighting produced thereby a thicker outer edge (preferably 125% of the original raw material thickness) without the need to alter the thickness of the original raw strip material to achieve higher wear resistance flighting.

In some screw conveyors embodying continuous rolled flighting, the conveyor screw may rotate at speeds of several hundred up to one thousand revolutions per minute. In such conveyors, the rotating screw imparts a considerable centrifugal action to the material being propelled axially by the screw. That centrifugal action causes the propelled material to be thrown radially outwards whilst it is being propelled forwardly. Thus wear is concentrated at the outer edge of the flighting where the thickness of the flighting blade is of paramount importance in determining the working life of the conveyor screw.

In contrast, in a screw conveyor having a flighting according to the present invention, the change in direction of the propulsion surface radially of the flighting at the step disposed at the radial termination of the said intermediate portion (neck) imparts a forward motion to the material sliding radially outwardly over the propulsion surface. This tends (a) to reduce the pressure of the propelled material on the outer part of that surface and consequently the wear of that surface, (b) to increase the forward velocity of the material being conveyed, (c) to reduce the pressure directing material into the gap between the screw and the casing and consequently the material being fed into that gap, and (d) to reduce the wear of the outer edge of the flighting.

Although a preferred embodiment of the invention has been specifically illustrated and described herein, it is to be understood that minor variations may be made in the apparatus without departing from the spirit and scope of the invention, as defined in the appended claims.

I claim:

1. A method of producing continuous rolled flighting, the flighting being suitable for use in screw conveyors and augers, including:

forming a continuous helical blade having radially spaced inner and outer helical edges from an elongated metal strip having a first length, a first height and a first thickness, wherein the first length of the strip is greater than its first height and the first height of the strip is greater than its first thickness and the cross-section of said metal strip is substantially constant along its length;

wherein said continuous helical blade is formed integrally by (i) an inner helical portion which extends radially from the inner helical edge to a predetermined intermediate radius portion and which extends radially to (ii) an outer helical portion which extends from the predetermined intermediate radius portion to the outer helical edge, the transverse thickness of the continuous helical blade in the inner helical portion decreasing gradually from a maximum value to a minimum value at the intermediate radius portion, and the thickness of the continuous helical blade in the outer helical portion being increased by cold forming from the first thickness of the metal strip forming the helical blade to a second thickness greater than the first thickness, wherein the outer helical portion is thickened from said first metal strip thickness to the second thickness without adding or attaching additional material to the metal strip during forming.

2. The method of claim 1, wherein said cold forming thickening of said outer helical portion is formed by compressing the height of said outer helical portion while expanding the thickness of the outer helical portion to said second thickness.

3. The method of claim 2, wherein the thickness at the inner helical portion is held substantially constant while thickening the outer helical portion of the flighting.

4. The method of claim 2, wherein said outer helical portion is cold formed by rolling the metal strip between a first and second rollers;

said first roller having a space defined therein for receiving a first end of said metal strip, said defined space having a width approximately equal to the thickness of the metal strip to maintain the thickness of the metal strip constant during pre-processing of the metal strip when said metal strip is compressed between the first and second rollers;

said second roller having a space defined therein for receiving a second end of said metal strip, said defined space having a width wider than the thickness of the metal strip to cause the thickness of the metal strip to flare and expand to said second thickness during pre-processing of the metal strip when said metal strip is compressed between the first and second rollers.

5. The method of claim 1, further comprising the steps of:

(a) providing a first and second opposed, mutually-inclined conical rolls for compressing the metal strip therein to form the thickness profile of said flighting;

(b) wherein at least the first conical roll has a central axis about which the conical roll rotates, and a stepped conical rolling surface has an apex conical section near the tip of the conical roll, a base section, and a neck section between said apex and base sections;

(c) providing said first conical roll with a graduated diameter-reducing step progressing from an apex conical section of the rolling surface to a neck conical section of the rolling surface to a base conical section of the rolling surface, whereby upon rolling a helical blade from a metal strip produces a pressure differential in adjoining inner, intermediate and outer helical portions respectively of the helical blade.

6. The method of claim 5, further comprising the steps of:

(a) rotating the first and second conical rolls in complementary directions;

(b) pre-processing the metal strip by cold rolling, where cold rolling includes introducing said metal strip to a compressor, whereby the metal strip is compressed to reduce the height dimension of the metal strip while increasing the width dimension of the metal strip;

(c) introducing said compressed metal strip between the rotating conical rolls thereby causing the metal strip to be converted by the rotating conical rolls into a helical blade constituting said continuous rolled flighting, the inner helical portion being formed by the apex conical section of the stepped rolling surface, an intermediate radius section being formed by the neck portion, and the outer helical portion being formed by the base conical section of the stepped rolling surface.

7. The method of claim 6, where said neck portion forms a constant, minimum thickness portion on said intermediate radius portion of said flighting.

8. The method of claim 1, further comprising pre-processing of the longitudinal metal strip by controlled height-wise compression exerted upon the upper and lower edges of the metal strip by rollers while further rollers retain by compression the width of the metal strip within the upper and lower edges.

9. The method of claim 1, further comprising pre-processing by height-wise compression of the longitudinal metal strip such that at least its lower edge increases in width to at least 125% of the original width of the metal strip prior to pre-processing from the first metal strip thickness to the second thickness.

10. The method of claim 1, further comprising the steps of:

(a) providing said first conical roll with a graduated diameter-reducing step progressing from an apex conical section of the rolling surface to a base conical section of the rolling surface thereby upon rolling a helical blade from a metal strip to produce a pressure differential in adjoining inner, intermediate and outer helical portions respectively of the helical blade;

(b) said apex conical section increasing from a first apex diameter to a second apex diameter at a constant apex diameter expansion rate along said apex section, said neck section increasing from a first neck diameter to a second neck diameter at a constant neck diameter expansion rate along said neck section, and said base section expanding from said first base diameter to a second base diameter;

(c) wherein said base section diameter expansion rate is less than the neck section diameter expansion rate;

(d) rotating the first and second conical rolls in complementary directions;

(e) introducing said metal strip to a compressor, whereby the metal strip is compressed to reduce the height dimension of the metal strip while increasing the width dimension of the metal strip;

(f) introducing said compressed metal strip between the rotating conical rolls thereby causing the metal strip to be converted by the rotating conical rolls into a helical blade constituting said continuous rolled flighting, the tapering inner helical portion being formed by the apex conical section of the stepped rolling surface, the intermediate, constant thickness radius section being formed by the neck portion, and the tapering outer helical portion being formed by the base conical section of the stepped rolling surface.

11. The method of claim 1, further comprising the steps of:

(a) providing said first conical roll with a graduated diameter-reducing step progressing from an apex conical section of the rolling surface to a base conical section of the rolling surface thereby upon rolling a helical blade from a metal strip to produce a pressure differential in adjoining inner, intermediate and outer helical portions respectively of the helical blade;

(b) said apex conical section increasing from a first apex diameter to a second apex diameter at a constant apex diameter expansion rate along said apex section, said neck section increasing from a first neck diameter to a second neck diameter at a constant neck diameter expansion rate along said neck section, and said base section expanding from said first base diameter to a second base diameter;

(c) wherein said neck section diameter expansion rate is less than said apex diameter expansion rate (d) rotating the first and second conical rolls in complementary directions;

(e) introducing said metal strip to a compressor, whereby the metal strip is compressed to reduce the height dimension of the metal strip while increasing the width dimension of the metal strip;

(f) introducing said compressed metal strip between the rotating conical rolls thereby causing the metal strip to be converted by the rotating conical rolls into a helical blade constituting said continuous rolled flighting, the tapering inner helical portion being formed by the apex conical section of the stepped rolling surface, the intermediate, constant thickness radius section being formed by the neck portion, and the tapering outer helical portion being formed by the base conical section of the stepped rolling surface.

12. The method of claim 10, wherein the thickness of the outer helical edge is at least twice the minimum thickness of the flighting in the intermediate radius section.

13. The method of claim 10, wherein pre-processing of the longitudinal metal strip is performed by controlled height-wise compression exerted upon the upper and lower edges of the metal strip by rollers while further rollers retain by compression the width of the metal strip to the first metal strip thickness within the upper and lower edges.

14. The method of claim 10, wherein pre-processing is performed by height-wise compression of the longitudinal metal strip such that at least its lower edge increases in width to at least 125% of the original width of the metal strip prior to pre-processing.

15. The method of claim 10, wherein pre-processing is performed by height-wise compression of the longitudinal metal strip such that at least its lower edge increases in width to at least 150% of the original width of the metal strip prior to pre-processing.

16. The method of claim 10, wherein pre-processing is performed by height-wise compression of the longitudinal metal strip such that at least its lower edge increases in width to at least 175% of the original width of the metal strip prior to pre-processing.

17. Apparatus for producing continuous rolled flighting suitable for use in screw conveyors and augers, the flighting including a continuous helical blade having radially spaced inner and outer helical edges, the continuous helical blade being formed integrally by (i) an inner helical portion which extends radially from the inner helical edge to a predetermined intermediate radius, (ii) an intermediate helical portion which extends radially from the predetermined intermediate radius portion and (iii) an outer helical portion , the transverse thickness of the continuous helical blade in the inner helical portion decreasing gradually from a maximum value at the outer edge to a minimum value at the intermediate helical portion, and the thickness of the continuous helical blade in the outer helical portion tapering outwardly to at least 150% of the minimum thickness of the flighting between the inner and outer edge of the helical blade; the apparatus comprising:

(a) a pair of opposed, mutually-inclined conical rolls of which at least a first of the conical rolls has a stepped conical rolling surface divided by graduated diameter-reducing steps progressing from an apex conical section of the rolling surface to an intermediate conical section of the rolling surface to a base conical section of the rolling surface thereby upon rolling a helical blade from a metal strip to produce pressure differentials in adjoining inner, intermediate and outer helical portions respectively of the helical blade;

(b) a driver for rotating the conical rolls in complementary directions;

(c) an introducer for introducing a continuous metal strip of substantially rectangular cross section and substantially constant height between the rotating conical rolls thereby causing the metal strip to be converted by the rotating conical rolls and the pressure differentials exerted on the metal strip into a helical blade constituting said continuous rolled flighting, the inner helical portion being formed by the apex conical section of the stepped rolling surface, the intermediate helical portion being formed by the intermediate conical section and the outer helical portion being formed by the base conical section of the stepped rolling surface and projecting outwardly on at least one side of the helical blade relative to an adjacent surface of the intermediate portion of the helical blade; and (d) a receiver for receiving and supporting the flighting upon emerging from the conical rolls;

wherein the conical rolls and the diameter-reducing steps of the first conical roll are constructed and arranged such that the conical rolls alone convert the continuous metal strip into said continuous helical blade, without substantially reducing the height of the metal strip and without a simultaneous application to the metal strip of pressures directed transversely to the pressures exerted on the metal strip by the conical rolls.

18. Apparatus according to claim 17, further comprising a metal strip compressor for pre-processing the metal strip by controlled height-wise compression applied by rollers to the upper and lower edges of the metal strip.

19. Apparatus according to claim 17, further comprising pre-processing cold rolling of the metal strip by height-wise compression of the longitudinal metal strip such that at least its lower edge increases in width to at least 125% of the original width of the metal strip prior to pre-processing.

20. A method of producing continuous rolled flighting, the flighting including a continuous helical blade having radially spaced inner and outer helical edges, the continuous helical blade being formed integrally by (i) an inner helical portion which extends radially from the inner helical edge to a predetermined intermediate helical portion, (ii) the intermediate helical portion having a generally constant thickness and (iii) an outer helical portion increasing in thickness less gradually than the inner helical portion and which extends from the intermediate helical portion to the outer helical edge, the transverse thickness of the continuous helical blade in the inner helical portion decreasing gradually from a maximum value at the outer helical edge to a minimum value at the intermediate helical portion, and the thickness of the continuous helical blade in the outer helical portion tapering outwardly to at least 150% of the minimum thickness of said flighting in said intermediate helical portion;

the method comprising the steps of:

(a) providing a pair of opposed, mutually-inclined conical rolls having their respective axes of rotation disposed in transversely offset planes with the axes of rotation having no common point of intersection of which at least a first of the conical rolls has a stepped conical rolling surface divided by graduated diameter-reducing steps progressing from an 'apex' conical section of the rolling surface to an intermediate conical section and said intermediate conical section progressing to a 'base' conical section of the rolling surface thereby upon rolling a helical blade from a metal strip to produce pressure differentials in adjoining inner, intermediate and outer helical portions respectively of the helical blade;

(b) rotating the conical rolls in complementary directions;

(c) introducing a continuous metal strip of substantially rectangular cross section and substantially constant height between the rotating conical rolls thereby causing the metal strip to be converted by the rotating conical rolls into a helical blade constituting said continuous rolled flighting, the inner helical portion being formed by the apex conical section of the stepped rolling surface, the intermediate helical portion being formed by the intermediate conical section and the outer helical portion being formed by the base conical section of the stepped rolling surface and projecting outwardly on at least one side of the helical blade relative to an adjacent surface of the intermediate portion of the helical blade; and (d) receiving and supporting the flighting upon emerging from the conical rolls;

the conical rolls and the diameter-reducing steps of the first conical roll being operative such that in performing step (c) the continuous metal strip is converted by the conical rolls alone into said continuous helical blade, without substantially reducing the height of the metal strip and without a simultaneous application to the metal strip of pressures directed transversely to the pressures exerted on the metal strip by the conical rolls.

21. The method of claim 20, further comprising pre-processing the metal strip by compressing the height of the longitudinal strip to increase the width of the strip prior to processing.

22. The method of claim 21, wherein said pre-processing compression and forming said flighting are performed on different portions of one metal strip simultaneously.

23. The method of claim 21, wherein said pre-processing compression and forming said flighting are separate, non-simultaneous operations.

24. The method of claim 20, further comprising pre-processing the metal strip by compressing the height of the longitudinal strip to increase the width of the strip by to at least 125% of the original width prior to processing.

25. The method of claim 20, wherein the slope of the intermediate conical section relative to the conical sections axis of rotation is less than the slope of the apex section.

* * * * *